United States Patent [19]

Lin

[11] Patent Number: 4,780,914

[45] Date of Patent: Nov. 1, 1988

[54] AUTOMATICALLY LIFTING DEVICE FOR TOILET SEAT

[76] Inventor: Hsien C. Lin, No. 6, Liang-Chow St., Taipei, Taiwan

[21] Appl. No.: 154,100

[22] Filed: Feb. 9, 1988

[51] Int. Cl.[4] ..... A47K 3/12

[52] U.S. Cl. ..... 4/236; 4/240; 16/298

[58] Field of Search ..... 4/236, 240, 251; 16/298, 299

[56] References Cited

U.S. PATENT DOCUMENTS

| | | | |
|---|---|---|---|
| 1,529,656 | 3/1925 | Kornhauser | 4/240 |
| 1,681,277 | 8/1928 | Booth | 4/236 |
| 2,181,017 | 11/1939 | Hill | 4/240 |
| 4,438,535 | 3/1984 | Paredes | 4/234 |

*Primary Examiner*—Charles E. Phillips

*Attorney, Agent, or Firm*—Wenderoth, Lind and Ponack

[57] ABSTRACT

It is an automatically lifting devise for toilet seat; the device mainly comprises a sleeve shaft, a sleeve, a main shaft, a torsional spring, and a torsion adjusting assembly. The aforesaid torsion adjusting assembly further includes a displacement shaft, a shaft seat, a worm gear and a worm. The feature of the aforesaid lifting device is that when the lid being lifted up, the toilet seat will be lifted upwards automatically and slowly because of the torsion of the torsional spring is higher than the gravity of the toilet seat, and because of a grease of high viscosity being coated on the surface between the sleeve shaft and the sleeve; moreover, the object of the torsion adjusting assembly is to adjust the torsion of the torsional spring after a long period of use so as to maintain the automatically lifting device to have a normal torsional spring and operation.

3 Claims, 3 Drawing Sheets

AUTOMATICALLY LIFTING DEVICE FOR TOILET SEAT

BACKGROUND OF THE INVENTION

This invention provides an automatically lifting device for toilet seat, by which the toilet seat can be lifted up automatically and slowly. The device has a torsion adjusting assembly to maintain the torsional spring in the device to operate normally.

The lifting structure for the toilet seat and the lid in the conventional toilet equipment may be classified as water-level difference type, foot-stepping type, hand-operating type, hydraulic type, electric operation type, and spring-control type, etc.; each of the aforesaid types has its feature; however, all of them have a common drawback, i.e., the lifting-up device having a complicated structure, which causes some difficulties in the assembling and installation work thereof; further, some of the aforesaid lifting devices can not be mounted on a toilet equipment before modifying the structure of that toilet equipment. Therefore, most of them have not met the requirements of practicality and economy.

SUMMARY OF THE INVENTION

In the present invention, a simple torsional spring is used the lifting device, and the feature of the device is that all parts are installed within an assembly housing to prevent the parts from being polluted and to have the whole device had a better appearance. Moreover, the device is furnished with a torsion adjusting assembly for adjusting and maintaining the torsion of the torsional spring always in a normal condition even after a long time use.

In addition, the present invention has some features as follows:

1. All the parts and the torsion adjusting assembly are mounted within the assembly housing to prevent from being polluted and to maintain the device in a sanitary condition.

2. Since all parts are tucked away, the toilet seat, the lid and the assembly housing look like an integrated piece, which provide a beautiful and sanitary appearance to the user.

3. The device according to the present invention can be manufactured separately without changing or modifying the conventional toilet equipment, and therefore it is deemed simple to install and being economical.

4. Since the toilet seat is lifted up slowly, there would be no impact or noise resulted.

5. The torsion of the torsional spring can be adjusted any time by means of the torsion adjusting assembly so as to improve the lifting-up speed of the toilet seat or to increase the torsion of the torsional spring, and therefore it is deemed to have a higher practicality.

6. The present invention has less parts, and therefore the manufacturing cost and assembling steps thereof are lower and simple. The popularity of the present invention can surely be expected.

Figure 1:
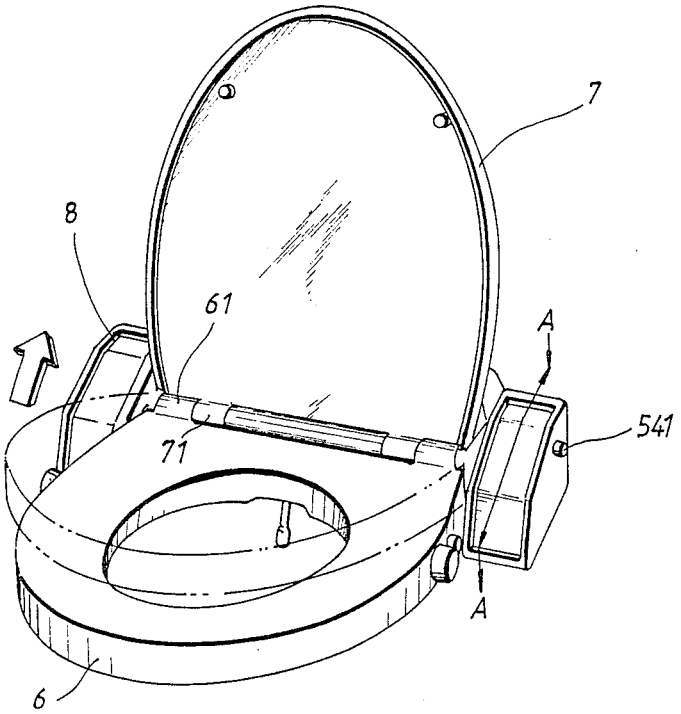
FIG. 1 is a perspective view of the embodiment according to the present invention, and the toilet seat and the lid.

DESCRIPTION OF THE PREFERRED EMBODIMENT:

As shown in the FIGS. attached, the automatically lifting device comprises a sleeve shaft 1, a sleeve 2, a main shaft 3, a torsional spring 4, and a torsion adjusting assembly 5. The structure of the aforesaid device is described as follows:

The sleeve shaft 1 is a substantially a cascade sleeve, of which the large diameter end is mounted inside the assembly housing, while the small diameter end is facing outward the assembly housing, and is mounted in the recess portions 81 at the both ends of the assembly housing for the toilet seat 6 and a lid 7. The sleeve shaft 1 is fixed in place with a pin 82. In the center of the small diameter end of the sleeve shaft 1, there is shaft hole 11 with a suitable depth for receiving one end of a main shaft to be described below.

Figure 3:
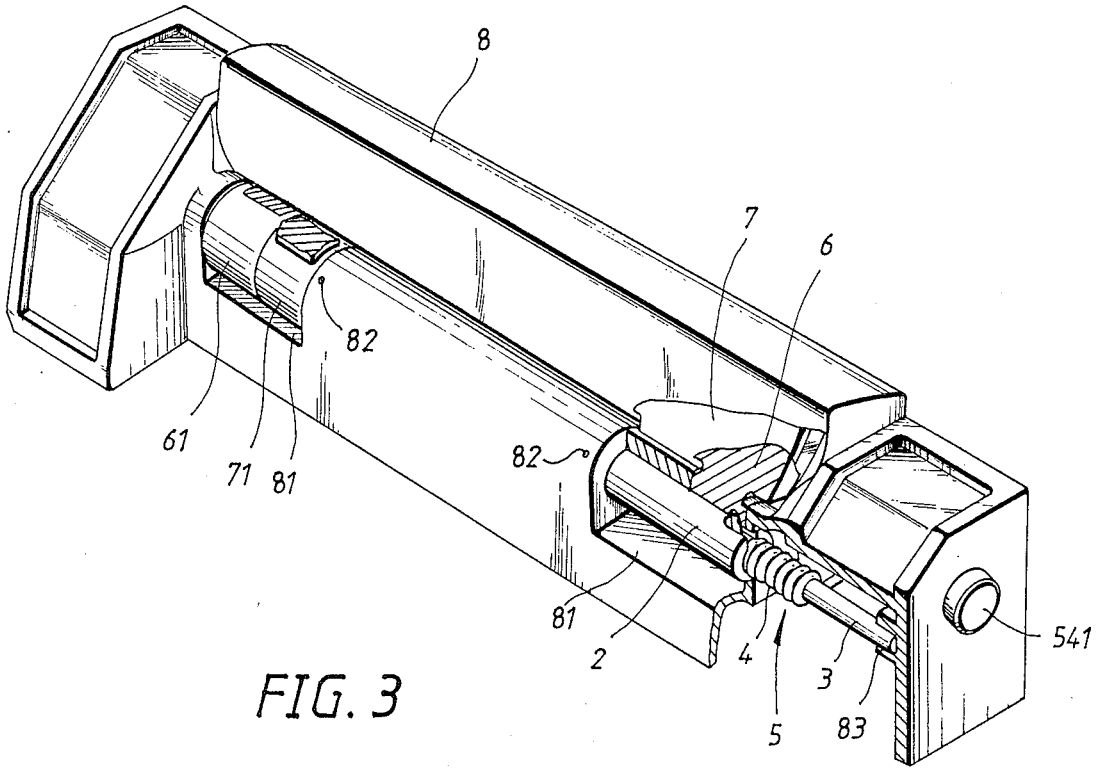
FIG. 3 is a perspective view and a fragmental sectional view of the present invention.
Figure 4:
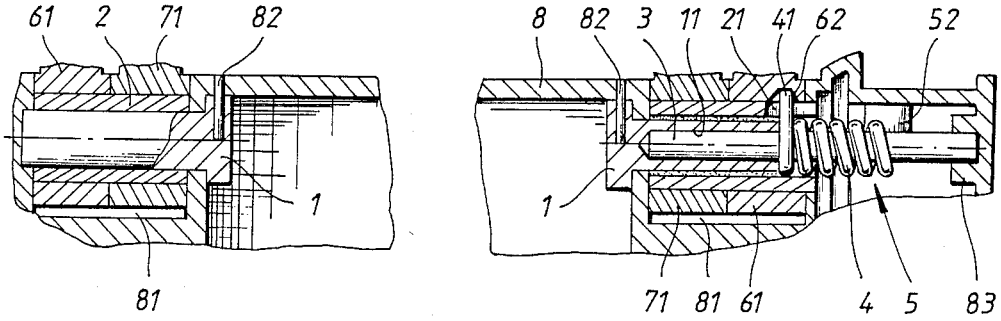
FIG. 4 is a crosssectional view showing the structure in FIG. 3.

A sleeve 2 is mounted over the small diameter end of the sleeve shaft 1, being positioned in a recess portion 81 of the assembly housing 8; the sleeve 2 is used for pivotally mounting the pivotal parts 61 and 71 of the toilet seat 6 and the lid 7 as shown in FIGS. 1 and 3. The length of sleeve 2 is longer than that of the small diameter portion of the sleeve shaft 1, and after the two parts being assembled together, the longer end beyond the sleeve shaft 1 has a slot 21. There is a play between the surfaces of the sleeve 2 and the small diameter portion of the sleeve shaft 1 so as to coat a layer of grease with high viscosity to have the sleeve 2 driven around the sleeve shaft 1 slowly as shown in FIG. 4.

A main shaft 3 has one end being inserted into the shaft hole 11 in the small diameter end of the sleeve shaft 1, while the other end of the shaft 3 is mounted in a socket 83 on the wall of the assembly housing 8, and the shaft 3 is in a stationary state for mounting a torsional spring 4 thereon.

Figure 5:
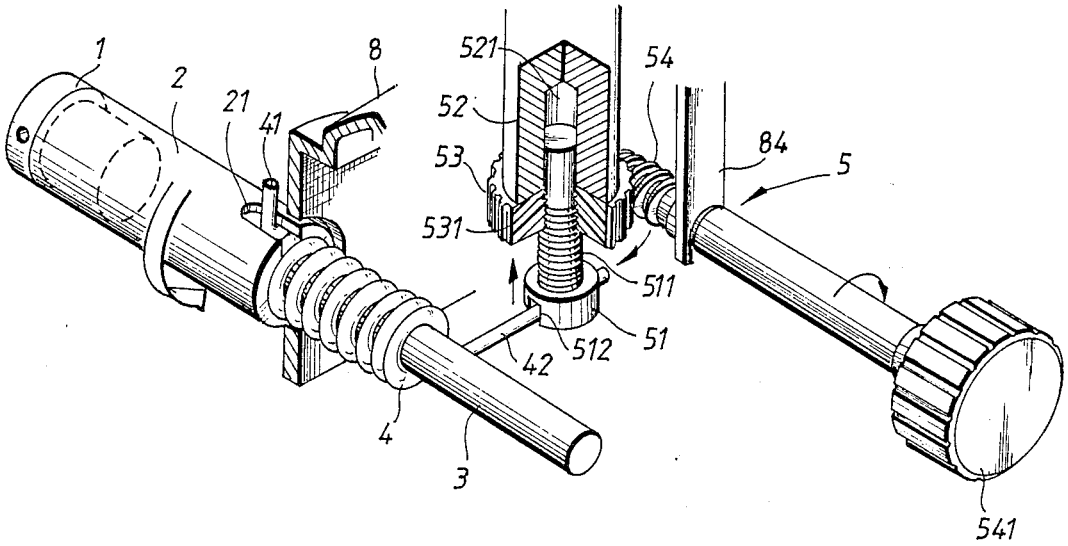
FIG. 5 is a longitudinal sectional view showing the structure in FIG. 4.

A torsional spring 4 is mounted around the main shaft 3. the first end of the torsional spring 4 is positioned in one end of the sleeve 2 against one end of the small diameter end of the sleeve shaft 1. The first end 41 has a straight portion passing through a slot 21 of the sleeve 2 and being inserted into a catch hole 62 on the pivotal part 61 of the toilet seat 6 as shown in FIG. 5. The second end of the torsional spring 4 has a horizontal extension part to be positioned and coupled with a displacement shaft 51 so as to have one end of the torsional spring 4 fixed in place. The torsional spring 4 is made of steel wire with a given diameter so as to provide a suitable torsional force, which is higher than the gravity of the toilet seat 6.

Figure 2:
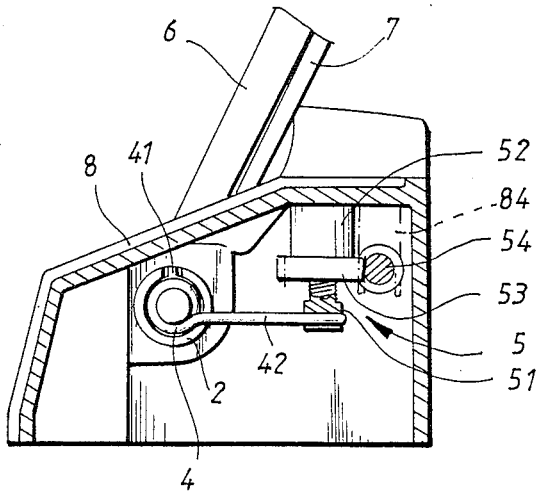
FIG. 2 is a sectional view taken along line A—A in FIG. 1.
Figure 6:
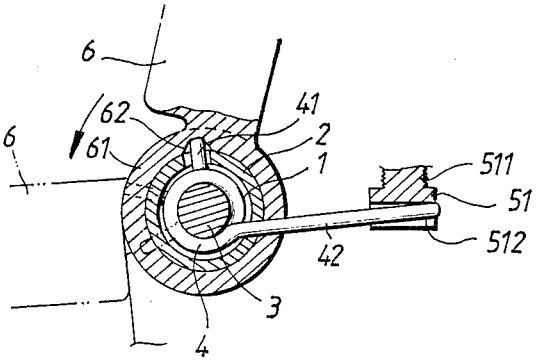
FIG. 6 is a perspective view of the torsion adjusting assembly of the torsional spring according to the present invnetion.

The torsion adjusting assembly of the torsional spring comprises a displacement shaft 51, a shaft seat 52, a worm gear 53, and a worm 54 as shown in FIG. 6. The displacement shaft 51 is mounted in the threaded hole 531 of the worm gear 53 by means of threads 511 so as to have the displacement shaft 51 mounted inside the center hole 521 of the shaft seat 52. The lower end of the displacement shaft has a slot 512, in which the second end 42 of the torsional spring 4 is retained. The worm gear 53 and the displacement shaft 51 are coupled each other, while the displacement shaft 51 is also inserted into the center hole 521 of the shaft seat 52 by means of a force from the second end of the torsional spring 4. The worm gear 53 has one side being engaged with a worm 54, of which one end extends out of the assembly housing 8, and is mounted with a knob 541. The shaft seat 52 and the assembly housing 8 are made into one stationary piece as shown in FIG. 2. The assembly housing 8 has a supporting plate 84, of which the lower end holds the worm 54 at a suitable position so as to have the worm 54 mounted in place firmly.

The torsion adjusting assembly 5 is used for adjusting the spring 4 after the spring 4 being used for a period of time to have the indication of fatigue of elasticity, or for changing the torsional force of that spring. The operation theory of the torsion adjusting assembly 5 is that the worm gear 53 is set in a given direction by rotating the worm 54. Since the displacement shaft 51 is controlled with the torsional spring 4 to be unable to rotate radially, and the shaft seat 52 is also a static member, the displacement shaft 51 can only be displaced axially upwards by its threads 511 so as to have the diametral pitch of the torsional spring 4 become closer each other to increase the torsional force; likewise, when the worm 54 is rotated reversely, the displacement shaft 51 will move downwards to cause the diametral pitch of the torsional spring 4 to become larger each other to decrease the torsional force.

The function and operation theory of the automatic toilet seat 6 are described as follows:

Normally, the toilet seat 6 is in a vertically standing position because of its force of gravity being less than the torsional force of the torsional spring 4, and the first end 41 of the spring 4 being retained in a catch hole in the pivotal part 61; a vertically standing toilet seat 6 will not be polluted. When using the toilet seat 6, the seat can be put in a horizontal position. Since the second end of the spring 4 is fixed in place, the spring 4 is under a torsional state, i.e., a torsion energy being stored. As soon as a person on the toilet seat stands up or leaves from the seat, the toilet seat 6 will be raised vertically immediately and automatically as a result of the torsional force of the torsional spring 4. When the toilet seat 6 being put in horizontal position, and the first end of the torsional spring 4 being retained in the slot 21 of the sleeve 2, the sleeve 2 can also be driven to rotate at a given angle. When the toilet seat 6 being driven to its original position by the spring 4, the sleeve 2 will also be driven to rotate back. Since a layer of grease with high viscosity is coated between the sleeve 2 and the sleeve shaft 1, the rotation of the sleeve 2 would be retarded, and therefore the stored energy to be released by the torsional spring 4 will also be retarded to cause the toilet seat 6 to be lifted slowly; in that case, no impact and noise would be resulted. When it is necessary to have the toilet seat 6 and the lid 7 put in horizontal position, both of them may be pulled downwards simultaneously; in such case, the gravity of the toilet seat 6 and the lid 7 will be much greater than the torsional force of the spring 4, and therefore both the seat 6 and the lid 7 would not be lifted by that spring 4. The whole lifting device is under a spring-energy-loaded state. In that case, the toilet seat 6 can be lifted up automatically but slowly by lifting the lid 7 first without causing any impact or noise.

I claim:

1. An automatic lifting device in combination with a toilet seat comprising, a housing containing at least a sleeve shaft, a sleeve, a main shaft, a torsional spring and a torsion adjusting assembly, and characterized in that;

said sleeve shaft being a cascade sleeve shape, of which a small diameter portion faces outwards and is mounted in a recess portion at one end of said housing, said sleeve shaft being fixedly positioned in said housing by a pin; the center portion of said small diameter portion being furnished with a shaft hole for receiving said main shaft;

said sleeve being mounted over the small diameter portion of said sleeve shaft and serving as a means for mounting a hinge portion of said toilet seat, said sleeve being longer in length than said small diameter portion, and projecting beyond said portion and having a slot in the area which projects beyond the small end portion said main shaft, having one end inserted in the shaft hole of said small diameter portion, while the other end is mounted in a socket at one end of said assembly so as to have both its ends fixed in place for mounting said torsional spring;

said torsional spring being mounted on said main shaft and the first end of said torsional spring being inserted into a catch hole located in said toilet seat, while the second end thereof has a horizontal portion extending laterally of said spring;

said torsion adjusting assembly including a displacement shaft, a shaft seat, a worm gear and a worm, and having the features as follows:

one end of said displacement shaft, having a slot to receive said second end of said torsional spring, a mid-portion of said displacement shaft having threads;

said shaft seat being mounted on said assembly, and having a center hole in the bottom center thereof for receiving the other end of said displacement shaft which can move axially in said center hole;

said worm gear being located on said shaft seat, and having a threaded hole for engaging with said threads of said displacement shaft, and said worm gear being retained in place by means of the upward force of said second end of said torsional spring, said worm having one end engaged with said worm gear and a second end of said worm extending out of said assembly and having a knob mounted thereon, and said end of said worm being supported with a supporting plate which is integrally molded with said housing;

the aforesaid device being operated by rotating said knob to drive said worm gear which due to its threaded engagement with said displacement shaft will cause said shaft to move upwards or downwards for changing the space between the diametral pitch of said torsional spring and adjusting the torsion of said torsional spring.

2. An automatic lifting device in combination with a toilet seat as claimed in claim 1, further comprising a lid hinged on said sleeve shaft, and wherein the torsion of said torsional spring is greater than the force of gravity on said toilet seat, but is smaller than the total force of gravity on said toilet seat and said lid.

3. An automatic lifting device in combination with a claimed in claim 1, wherein said sleeve rotates synchronously with said torsional spring for driving said toilet seat to lift it upwards; and a coating of a grease with high viscosity coated on the surface between said sleeve and said small diameter end of said sleeve shaft to retard the release of the energy of said torsional spring torsional spring to lift said toilet seat slowly.

* * * * *